US007988460B1

(12) United States Patent
Chiu et al.

(10) Patent No.: US 7,988,460 B1
(45) Date of Patent: Aug. 2, 2011

(54) ELECTRICAL ENGAGEMENT STRUCTURE OF CONNECTION DEVICE

(75) Inventors: Jeremy S. Chiu, Taipei (TW); Hsuan-Ho Chung, Bade (TW)

(73) Assignee: DNOVA Corporation, Taipei (TW)

( * ) Notice: Subject to any disclaimer, the term of this patent is extended or adjusted under 35 U.S.C. 154(b) by 0 days.

(21) Appl. No.: 12/862,767

(22) Filed: Aug. 25, 2010

(51) Int. Cl.
*H01R 12/00* (2006.01)

(52) U.S. Cl. ..... 439/76.1; 439/660

(58) Field of Classification Search ..... 439/76.1, 439/607.05, 607.14, 607.26, 620.21–620.23, 439/660
See application file for complete search history.

(56) References Cited

U.S. PATENT DOCUMENTS 6,241,534 B1 * 6/2001 Neer et al. ..... 439/76.1
6,948,983 B1 * 9/2005 Peng ..... 439/660
7,165,998 B2 * 1/2007 Lee et al. ..... 439/660
7,359,208 B2 * 4/2008 Ni ..... 361/752
7,540,786 B1 * 6/2009 Koser et al. ..... 439/660
7,575,481 B1 * 8/2009 Liu ..... 439/660
7,798,820 B2 * 9/2010 Hong ..... 439/76.1
7,806,733 B2 * 10/2010 Lee et al. ..... 439/660
7,819,802 B2 * 10/2010 Secora ..... 600/300
7,824,227 B1 * 11/2010 Lee et al. ..... 439/660

* cited by examiner

*Primary Examiner* — Thanh-Tam T Le
(74) *Attorney, Agent, or Firm* — Leong C. Lei

(57) ABSTRACT

A connection device includes an electrical engagement structure. The connection device includes a connector and a printed circuit board (PCB) based tongue. The PCB based tongue is received and retained in the connector and has a distal end extending toward an open-cavity plug receiving side of the connector in such a way that side edges of the tongue are spaced from corresponding inner walls of the connector. As such, the connector is made compatible to various buses through the PCB based tongue that include contacts that are selectively arranged to correspond to the buses.

2 Claims, 4 Drawing Sheets

ELECTRICAL ENGAGEMENT STRUCTURE OF CONNECTION DEVICE

TECHNICAL FIELD OF THE INVENTION

The present invention generally relates to an electrical connection device, and more particularly to an electrical engagement structure of connection device compatible to HDMI, USB2.0, USB3.0, E-SATA, display port, combined HDMI and E-SATA, and combined HDMI and display port.

DESCRIPTION OF THE PRIOR ART

Electronic devices are commonly available and used today. Electronic devices establish electrical connection therebetween through electrical connectors. Nowadays, it is a commonplace to mount electrical connectors on a circuit board so that various connection ports are formed of electrical connectors. Examples include a main board of a computer, a circuit board of a mobile phone, and circuit boards for various electronic devices, which are provided with connectors for establishing electrical connection with external devices. In this way, the electronic devices may be set in electrical connection with each other for interchange of data, or for connection to a network, such as Internet.

For an electrical connector, structurally, it comprises a plurality of conductive terminals, which can be set in electrical engagement with conductive pads formed on a printed circuit boards or corresponding conductive terminals of a mated connector to realize transmission of electrical signals therebetween. With the progress of technology and the increasingly severe requirements of the general consumers for the electronic devices, the development of universal serial bus (USB) makes a significant improvement in both transmission speed and performance. However, concurrent with the improvement of electrical performance, miniaturization is also a trend for electrical connectors of electronic devices.

Taking a multi-functional RJ connector that has a detachable inner casing as an example, the connector comprises a female base forming an opening, a printed circuit board received in the opening. The printed circuit board forms thereon a plurality of contact pads. A male plug forms a cavity. When the male plug is fit into the opening of the female base, the cavity is used to accommodate the printed circuit board. The male plug comprises conductive pins arranged on opposite sides of the cavity whereby when the male plug is fit into the opening of the female base, the conductive pins are brought into engagement with the conductive pads formed on corresponding surfaces of the printed circuit board.

Such a multi-functional RJ connector having detachable inner casing suffers several drawbacks in the operation thereof:

This known technology is based on an RJ connector. When there is a need to connect to various multimedia functions, such as communication modem or networking function of a personal computer, each function requires at least one of their own connector. The need of two or more modular connectors of different specifications requires an expansion of size of the device. However, increasing size is not a desired condition for design, especially for handheld or laptop computers.

SUMMARY OF THE INVENTION

Thus, the present invention aims to provide an electrical connection device that has an electrical engagement structure compatible to HDMI, USB2.0, USB3.0, E-SATA, display port, combined HDMI and E-SATA, and combined HDMI and display port.

The primary objective of the present invention is to provide a connector that receives therein a printed circuit board (PCB) based tongue. The PCB based tongue defines USB2.0 bus, USB3.0 bus, HDMI bus, E-SATA bus, combined HDMI and E-SATA bus, combined HDMI and display port bus, combined USB and RJ45 bus, combined USB and HDMI bus, and/or display port bus. The connector has an outer configuration of RJ type, ND type, USB type, HDMI type, E-SATA type, combined HDMI and E-SATA type, combined HDMI and display port type, combined USB and RJ45 type, combined USB and HDMI type, or display port type. The PCB based tongue comprises one set of contacts formed a surface or more sets of contacts arranged in front and rear portions on the surface, or alternatively, comprises one or more sets of contacts arranged in front and rear portions of a surface and also comprises one or more sets of contacts arranged in front and rear portions of an opposite surface for transmission of signals. The connector has an open-cavity plug receiving side, which corresponds to and is mateable with a male plug, which forms a cavity engageable with the PCB based tongue, whereby when the male plug is fit into the open-cavity plug receiving side of the connector, the cavity of the male plug engages the contacts of the PCB based tongue to form electrical connection therebetween. With such an arrangement, the drawback found in the conventional connectors that when there is a need to connect to various multimedia functions, such as communication modem or networking function of a personal computer, each function requires at least one of their own connectors and the need of two or more modular connectors of different specifications requires an expansion of size of the device, which is not a desired condition for design, especially for handheld or laptop computers can be effectively overcome by the present invention through combination made between a connector and a PCB based tongue, by which compatibility is made with respect to buses of HDMI, USB2.0, USB3.0, E-SATA, display port, combined HDMI and E-SATA, combined HDMI and display port, combined USB and RJ45, and combined USB and HDMI, and practical improvement is realized.

The foregoing objectives and summary provide only a brief introduction to the present invention. To fully appreciate these and other objects of the present invention as well as the invention itself all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
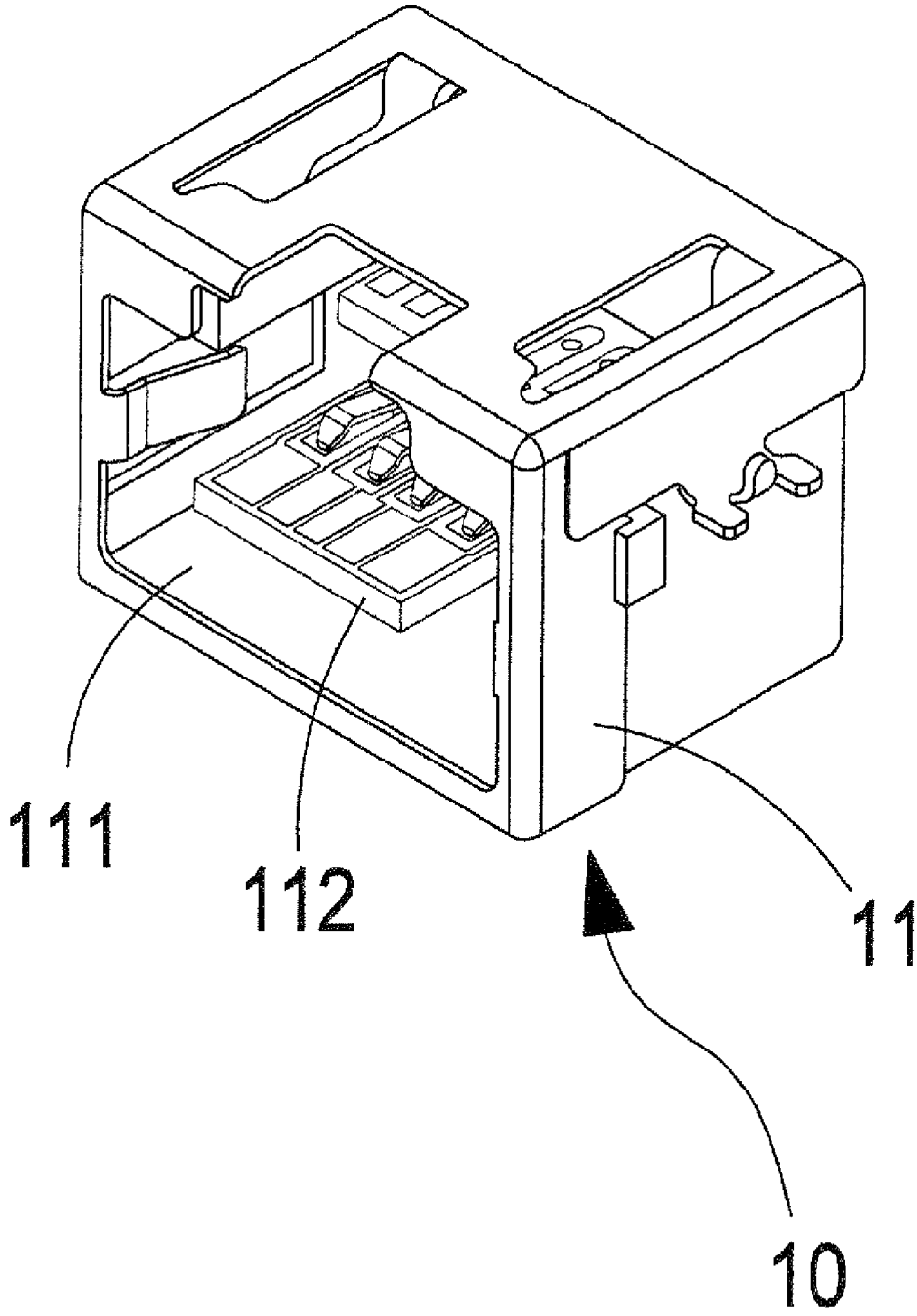
FIG. 1 is a perspective view showing a preferred embodiment of the present invention.
Figure 2:
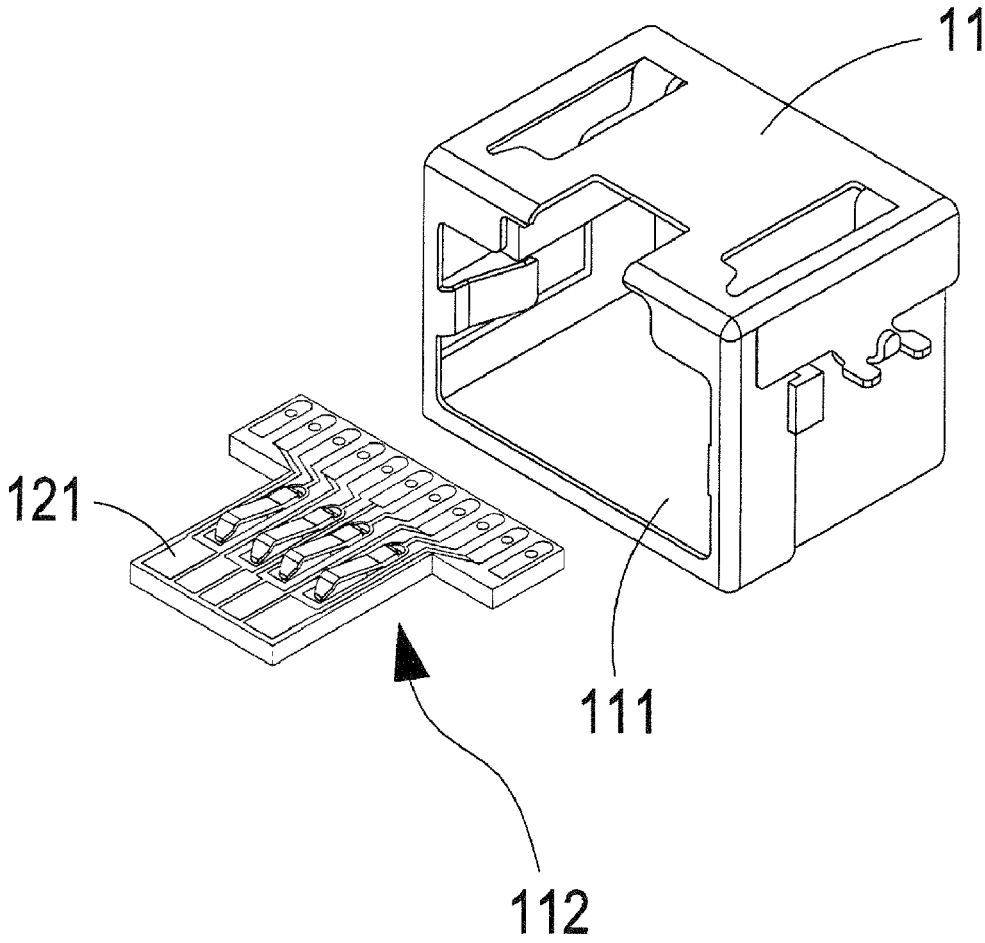
FIG. 2 is an exploded view showing the preferred embodiment of the present invention.

Referring to FIGS. 1 and 2, which are respectively a perspective view and an exploded view of a connection device, which is generally designated at 10, constructed in accordance with the present invention, the connection device 10 comprises a connector 11, which has an open-cavity plug receiving side 111, in which a printed circuit board (PCB) based tongue 112 is received. The PCB based tongue 112 has a distal end extending toward the open-cavity plug receiving side 111 and side edges that are spaced from corresponding inner walls of the connector 11. The PCB based tongue 112 comprises one set of contacts 121 formed a surface or more sets of contacts 121 arranged in front and rear portions on the surface, or alternatively, comprises one or more sets of contacts arranged in front and rear portions of a surface and also comprises one or more sets of contacts arranged in front and rear portions of an opposite surface. These contacts 121 are arranged to define a USB2.0 bus, a USB3.0 bus, an HDMI bus, an E-SATA bus, a combined HDMI and E-SATA bus, a combined HDMI and display port bus, a combined USB and RJ45 bus, a combined USB and HDMI bus, and/or a display port bus. Through these contacts, mating and engagement of the connector 11 with buses compatible with the PCB based tongue. The connector 11 can be structured to form an outside configuration of an RJ type, a PJD type, a USB type, an HDMI type, an E-SATA type, a combined HDMI and E-SATA type, a combined HDMI and display port type, a combined USB and RJ45 type, a combined USB and HDMI type, or a display port type.

Figure 3:
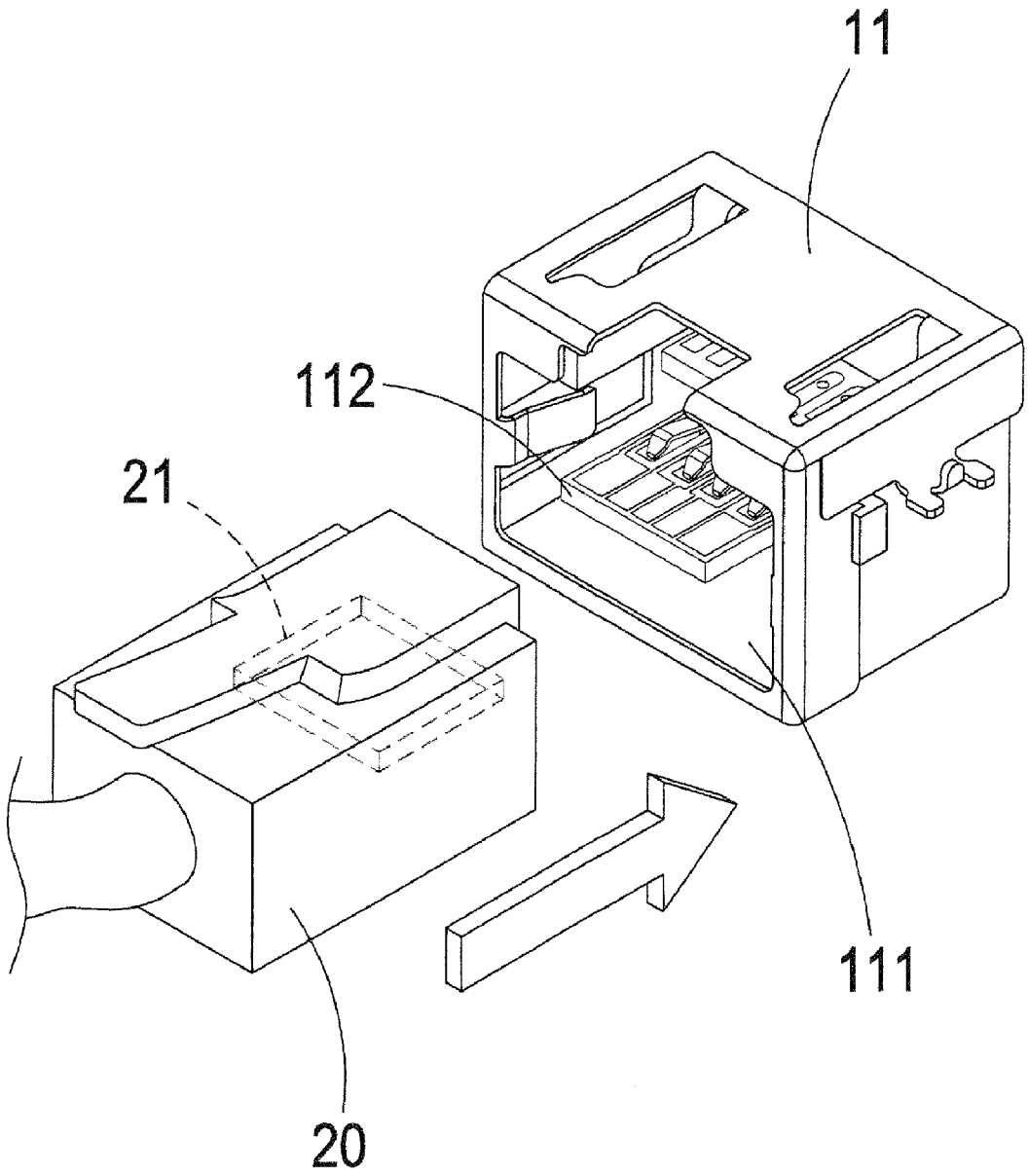
FIG. 3 is a perspective view showing an application of the preferred embodiment of the present invention.

Referring to FIGS. 2 and 3, which are respectively a perspective view of the present invention and a perspective view showing an application of the present invention, the connector 11 has an open-cavity plug receiving side 111, which receives and fixes therein a PCB based tongue 112, whereby the open-cavity plug receiving side 111 corresponds to and is mateable with a male plug 20, which forms a cavity 21 that is engageable with the PCB based tongue 112. The male plug 20 can be of an outer configuration of an RJ type, a PJD type, a USB type, an HDMI type, an E-SATA type, a combined HDMI and E-SATA type, a combined HDMI and display port type, a combined USB and RJ45 type, a combined USB and HDMI type, or a display port type. When a user attempts to electrically connect the connector 11 and the male plug 20, through the contacts of the PCB based tongue 112, which defines a USB2.0 bus, a USB3.0 bus, an HDMI bus, an E-SATA bus, a combined HDMI and E-SATA bus, a combined HDMI and display port bus, a combined USB and RJ45 bus, a combined USB and HDMI bus, or a display port bus, the cavity 21 of the male plug 20 and the open-cavity plug receiving side 111 are fit to and coupled to each other so that the cavity 21 and the PCB based tongue 112 engage each other to form electrical connection between. The connector 11 can be of an outer configuration of an RJ type, a PJD type, a USB type, an HDMI type, an E-SATA type, a combined HDMI and E-SATA type, a combined HDMI and display port type, a combined USB and RJ45 type, a combined USB and HDMI type, or a display port type. For example, the connector 11 that forms the PCB based tongue 112 can be of a USB type and is mateable with a male plug 20 that is also of a USB type.

Figure 4:
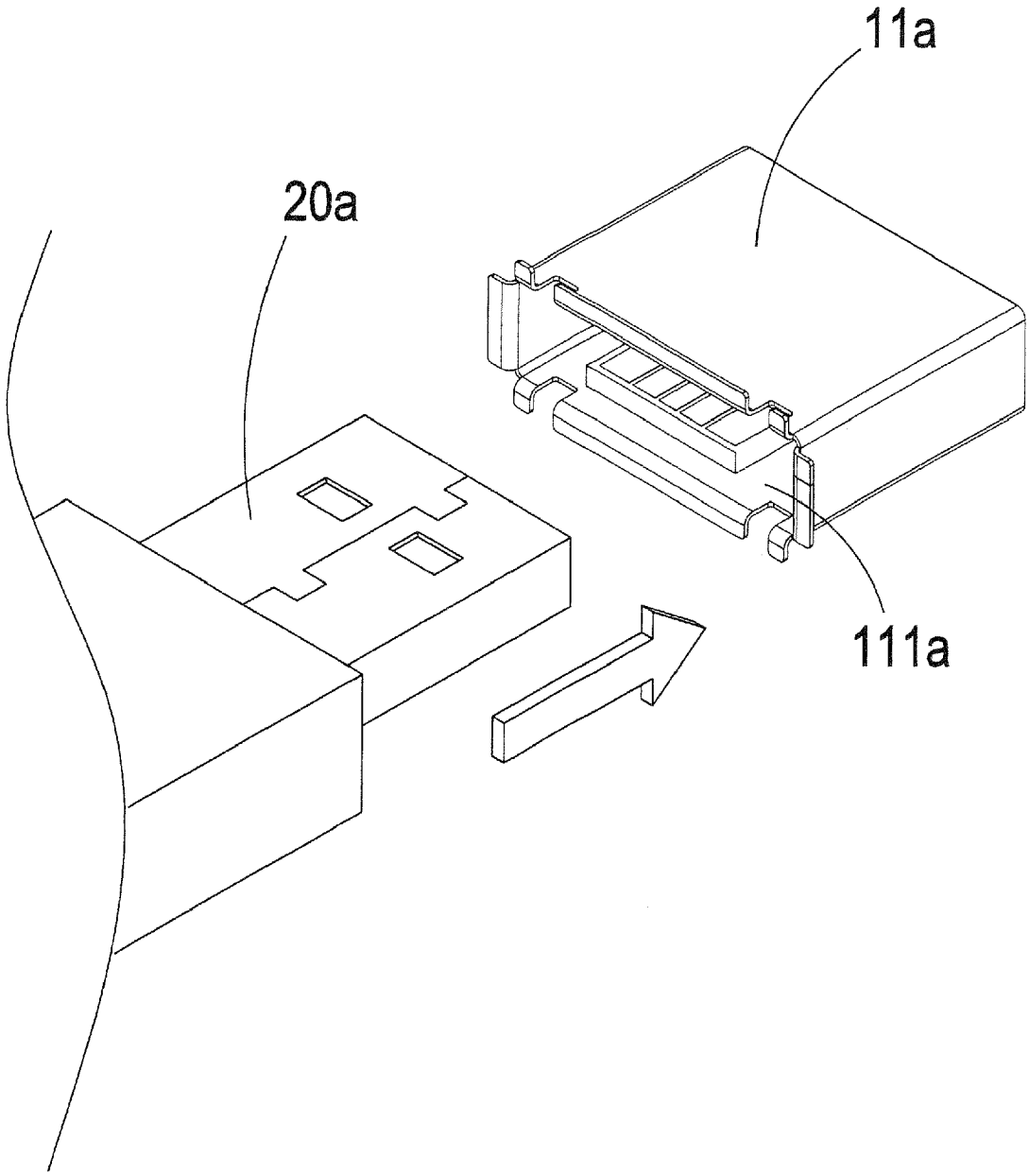
FIG. 4 is a perspective view showing an application of another embodiment of the present invention.

Referring to FIG. 4, which is a perspective view showing an application of another embodiment of the present invention, a connector ha has an open-cavity plug receiving side 111*a*, which functions to receive a male plug 20*a* to fit therein. The connector 11*a* can be of an RJ type or a PJD type, and corresponding thereto, the male plug 20*a* is of a corresponding type to the connector 11*a*, namely the male plug 20*a* can be an RJ type or a PJD type, so that they are engageable with each other to form electrical connection therebetween. This is also applicable to other types, such as HDMI or E-SATA.

The present invention offers the following advantages:

The PCB based tongue 112 forms various types of bus, such as USB2.0 bus, USB3.0 bus, HDMI bus, E-SATA bus, combined HDMI and E-SATA bus, combined HDMI and display port bus, combined USB and RJ45 bus, combined USB and HDMI bus, and/or display port bus, and the connector 11 can be of various types, such as RJ type, PJD type, USB type, HDMI type, E-SATA type, combined HDMI and E-SATA type, combined HDMI and display port type, combined USB and RJ45 type, combined USB and HDMI type, or display port type. Similarly, the male plug 20 that is mateable with the connector 11 can be set in connection therewith according to the types of the connector 11. Thus, the PCB based tongue 112 can be received and arranged inside the connector 11 that can be of various type, whereby the greatest compatibility and the most expanded applications can be realized and the amount of space occupied is greatly reduced.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A connection device comprising:

a connector having an open-cavity plug receiving side, said connector having an outer configuration that is of RJ type, PJD type, USB type, HDMI type, E-SATA type, combined HDMI and E-SATA type, combined HDMI and display port type, combined USB and RJ45 type, combined USB and HDMI type, or display port type;

a printed circuit board based tongue having a distal end extending toward said open-cavity plug receiving side and side edges that are spaced from corresponding inner walls of said connector, said printed circuit board based tongue having a surface on which one set of contacts or more sets of contacts arranged in front and rear portions thereof are formed, said contacts being arranged to define a USB2.0 bus, a USB3.0 bus, an HDMI bus, an E-SATA bus, a combined HDMI and E-SATA bus, a combined HDMI and display port bus, a combined USB and RJ45 bus, a combined USB and HDMI bus, and a display port bus; and a male plug mateable with said open-cavity plug receiving side and having a cavity engageable with said printed circuit board based tongue, said male plug having an outer configuration of RJ type, PJD type, USB type, HDMI type, E-SATA type, combined HDMI and E-SATA type, combined HDMI and display port type, combined USB and RJ45 type, combined USB and HDMI type, and display port type.

2. The connection device as claimed in claim 1, wherein said printed circuit board based tongue has an opposite surface on which one set of contacts or more sets of contacts arranged in front and rear portions thereof are formed.

* * * * *